US008418500B2

(12) United States Patent
Dugger

(10) Patent No.: US 8,418,500 B2
(45) Date of Patent: Apr. 16, 2013

(54) FLEXIBLE MASS SUPPORT APPARATUS

(76) Inventor: Linda Marie Dugger, Denver, CO (US)

( * ) Notice: Subject to any disclaimer, the term of this patent is extended or adjusted under 35 U.S.C. 154(b) by 197 days.

(21) Appl. No.: 12/958,384

(22) Filed: Dec. 1, 2010

(65) Prior Publication Data

US 2012/0137729 A1 Jun. 7, 2012

(51) Int. Cl.
*A44C 5/12* (2006.01)

(52) U.S. Cl.
USPC ..... 63/3; 63/11; D11/3

(58) Field of Classification Search ..... None
See application file for complete search history.

(56) References Cited

U.S. PATENT DOCUMENTS 4,718,252 A 1/1988 Fossas
4,763,489 A 8/1988 Strong
5,054,299 A 10/1991 Maveety
D456,733 S 5/2002 Hafner
D511,308 S 11/2005 Gay
D545,715 S 7/2007 Thiessen
7,313,929 B2 * 1/2008 Lazor ..... 63/3

* cited by examiner

*Primary Examiner* — Jack W. Lavinder
(74) *Attorney, Agent, or Firm* — Roger A. Jackson

(57) ABSTRACT

The present invention is a flexible mass support apparatus that is designed to be partially positioned about an article such as a neck, wrist, or ankle. The present invention includes a flexible element having a longitudinal axis disposed in between a first end portion and a second end portion wherein the flexible element further assumes a configuration of a portion of a Archimedean spiral shape. Further included in the present invention is a primary mass disposed adjacent to the first end portion and a secondary mass disposed adjacent to the second end portion. Operationally, the flexible element is manually expanded and positioned about the article, and the primary and secondary masses reverse the expanded state to further place the flexible element about the article in a closed state.

6 Claims, 10 Drawing Sheets

FLEXIBLE MASS SUPPORT APPARATUS

TECHNICAL FIELD

The present invention relates generally to a flexible apparatus that supports a mass. More particularly, it relates to a flexible apparatus that supports a mass and is capable of being worn as a necklace without the need for a fastener. The present invention preferably addresses this situation by having a mass at each end of a flexible element that slides easily on and off of the neck of the person wearing it, and remains in place without a fastener and without unnecessarily sliding around the neck.

FIELD AND BACKGROUND

Women and men alike frequently adorn their bodies with jewelry for both aesthetic and functional reasons. Jewelry or ornamentation to be placed around a person's neck is generally called a necklace. Necklaces can take many forms: being chunky or dainty, made out of plastic or metal, having a long or short diameter, or being flexible or rigid. It may also encircle the neck or be open at some point, and may include a clasp or other fastener to secure the necklace around the neck of the person wearing it. The necklace clasp fasteners can be very tiny and difficult to utilize without the aid of either a mirror or another person's assistance. Further for children, the elderly, and persons with reduced dexterity and/or eyesight may be left unable to move the clasp from an open operational state, defined as having the clasp open and the necklace off of the person, to a closed operational state, defined as having the clasp closed or engaged and the necklace encircling the person's neck. Such that in the absence of another person's assistance, such people will be left unable to wear their desired jewelry.

The necklace clasp fasteners also cause additional problems, as the clasp-style fasteners can break or become stuck, rendering the necklace unable to be worn without repair. As the clasps tend to be extremely small for the purpose of not being visually obvious, are often difficult to manage for even the most dexterous persons, especially if they lack the benefit of long fingernails to aid in opening and closing the clasp. In addition, these clasps also have tiny parts that stick out and may rub on the back of the person's neck causing discomfort and chaffing and utilizing a larger clasp with smoother connecting parts is not necessarily a feasible solution, as it would likely destroy the aesthetic appeal of the necklace.

Necklaces can also fasten around a person's neck by tying two elements together, however this too causes problems. Should the elements be tied too loosely, they may untie on their own and the necklace may slip off unbeknownst to the person wearing it, and if they are tied too tightly, the necklace may be very difficult to remove.

Additionally, because necklaces most typically encircle the neck, should they be grabbed by another person or caught on an object, damage may occur to the jewelry itself or the person wearing it could be injured. A woman walking down the street might have her necklace grabbed from behind by a mugger and depending on the durability of the material the necklace is made out of, could suffer great injury to her neck if it does not easily slide off or break. In another situation a child could fall and catch her necklace on a protruding object, strangling or injuring herself or destroying the necklace entirely. In yet another situation a woman shredding documents in an office might lean too far over the shredder and catch her long necklace between the blades and if the necklace is strong enough, it will neither break nor slide quickly off, endangering the woman's safety, and leading to potential strangulation or neck injury.

Furthermore, as an aesthetic matter, necklaces tend to shift around a person's neck while they are being worn. With necklaces consisting of a pendant on a chain or wire, or simply a bare chain and clasp, it is almost inevitable that the clasp or fastener will eventually slide around to the front where it does not belong requiring the person wearing it to readjust the necklace, as the clasp will typically have more mass (weight) than its adjacent chain portion, thus by virtue of the person having neck movement while wearing the necklace, the clasp will tend to undesirably gravitate to the bottom front of the person wearing it from the normal starting position of the clasp at the rear of the neck at the highest point (being the most hidden position for the clasp). This frequent readjustment demands vigilance from the person wearing the necklace, and may even lead to self-consciousness. This same problem exists to a greater degree of annoyance in necklaces that are more fixed in design. If the masses of the design are not properly balanced, one mass may constantly pull downwards, causing other masses or elements to be pulled behind the neck and hidden from view, destroying the aesthetic appeal, and causing additional annoyance and hassle.

In looking at the prior art, these aforementioned issues have somewhat been recognized and attempts to address some of these concerns by designing clasp-less necklaces with a large enough diameter to fit over the person's head, or clasp-less necklaces with an opening either in the front or in back, moldable necklaces that are rigid enough to maintain their shape once the person has formed it, and necklaces with interchangeable pieces which may be assembled and disassembled easily. However, problems still remain, in the area of personal safety, and damage to, or complete destruction of the jewelry are still concerns should the necklace be grabbed from behind, or become caught on another object. Also, ease of use is still a concern for children, the elderly, and persons with reduced dexterity or eyesight; and aesthetic concerns may still arise from improperly balanced masses as previously described.

Starting with U.S. Pat. No. 4,718,252 to Fossas disclosed is a means of providing balance to a necklace such that pressure on the neck caused by increased necklace diameter is alleviated. As shown by Fossas in FIG. 5B, this invention may still feature a clasp which may be difficult for children or persons with reduced dexterity or eyesight to operate, and the encircling nature of the necklace shown in FIGS. 1, 5A, 5B, and 6 still leaves open the possibility of damage to the jewelry or injury to the person wearing it should it be grabbed or caught. Additionally, though Fossas attempts to provide a semblance of balance to the necklace, it is achieved by including elements, as seen in FIGS. 2A, 2B, 3A, 3B, and 4, that essentially fix the necklace over the top of the person's shoulders to hold it in place. As discussed in column 1, lines 56-61, the purpose of the Fossas design is to allow people to wear longer necklaces without suffering the additional pressure exerted on the back of the neck that would typically accompany a necklace with a larger diameter. Furthermore, one can imagine the annoyance and discomfort caused if the more flexible shoulder rests Fossas discloses in FIG. 2B or 4 were to slide off of the person's shoulders.

Continuing in the prior art, in U.S. Pat. No. 4,763,489 to Strong discloses modular jewelry that may easily be put together and rearranged to create differing styles. While Strong allows for easy assembly and disassembly, like Fossas, the problem of the possibility of damage to the jewelry or injury to the person wearing it still exists. In column 3, lines

20-28, Strong describes how the elements may be easily assembled and disassembled yet they are still designed to remain attached until the person purposefully disassembles them. In column 3, lines 33-38, Strong further discusses the object of the invention to keep from damaging clothing or causing injury to the person wearing the necklace, however Strong refers to using a method of attaching the elements without requiring a structure with sharp edges or which protrudes significantly beyond the body of the jewelry. Nowhere does Strong address a piece that is easily put on and taken off for both ease of use, and personal safety. Also, like Fossas, the necklace embodiment of Strong is susceptible to imbalance, requiring the person wearing it to frequently readjust the jewelry to maintain its aesthetic appearance.

Additionally, in U.S. Pat. No. 5,054,299 to Maveety discloses pliable jewelry without fasteners meant to be bent around portions of a person's body and worn. While Maveety indeed makes it easier for children, the elderly, and persons with reduced dexterity or eyesight to wear the jewelry, this jewelry appears thick, chunky, and heavy, further such persons may desire to wear something daintier and lighter or more suitable for a formal occasion. FIGS. 7 and 15 of Maveety illustrate the thick and chunky nature of this jewelry, and column 1, lines 36-39, describes the jewelry as being made out of bendable metal surrounded by a rubber-type material. This style may be appropriate for casual occasions, but it is likely inappropriate in a more formal context. Maveety is designed to maintain its shape based on the rigidity of the material used, as opposed to the balance of weights on the piece, and as such the person wearing may not be able to consistently bend the necklace into the same shape. Furthermore, due to Maveety's requirement that the material be rigid enough to hold its shape once the person forms it, should it be grabbed from behind or caught on an object, it is not likely to come off without significant injury or discomfort.

Further in the prior art, in U.S. Design Pat. No. 456,733 to Hafner teaches the general concept of a necklace without a fastener which is open at the front. However, as this is a design patent, there is no text to teach anything regarding the balance of the masses, or the flexibility of the wire. Hafner might drape loosely around the neck, or might be made out of a material so rigid it would be difficult to put on and take off. If the material is too flexible it could be very difficult to keep the necklace in its desired position, especially exacerbated if the masses are not properly balanced.

Continuing, in U.S. Design Pat. No. 511,308 to Gay is another design patent teaching the same general concept as Hafner, and U.S. Design Pat. No. 514,976 to Gay is yet a third. Without text to teach regarding the balance of masses or the flexibility of the wire, we are left ignorant, and must guess as to what will work best.

Furthermore, in U.S. Design Pat. No. 545,715 to Thiessen teaches the general concept of a necklace without a fastener which is open instead at the back. However, like the design patents to Gay and the design patent to Hafner, Thiessen has no text to teach regarding the flexibility of the wire, or balance of the weights. The potential for personal injury, or for disfigurement or damage to the necklace should it be grabbed from behind or caught on another object still exists.

What is needed in the present invention is a piece of jewelry without a fastener clasp capable of being worn as a necklace suitable for both casual and formal occasions, made out of a flexible element which is easily manipulated, yet rigid enough to maintain an aesthetically pleasing shape around a person's neck when masses are balanced at each end. This piece of jewelry should be easy enough for all persons including children, the elderly, and persons with reduced dexterity or eyesight to move from an open operational state, defined as holding the necklace open such that it can be placed around a person's neck, to a closed operational state, defined as allowing the necklace to rest naturally around a person's neck. This feature would also protect their personal safety should the necklace be grabbed from behind or caught on another object because it would easily slide off of the person without injury or damage to the necklace.

SUMMARY OF INVENTION

Figure 1:
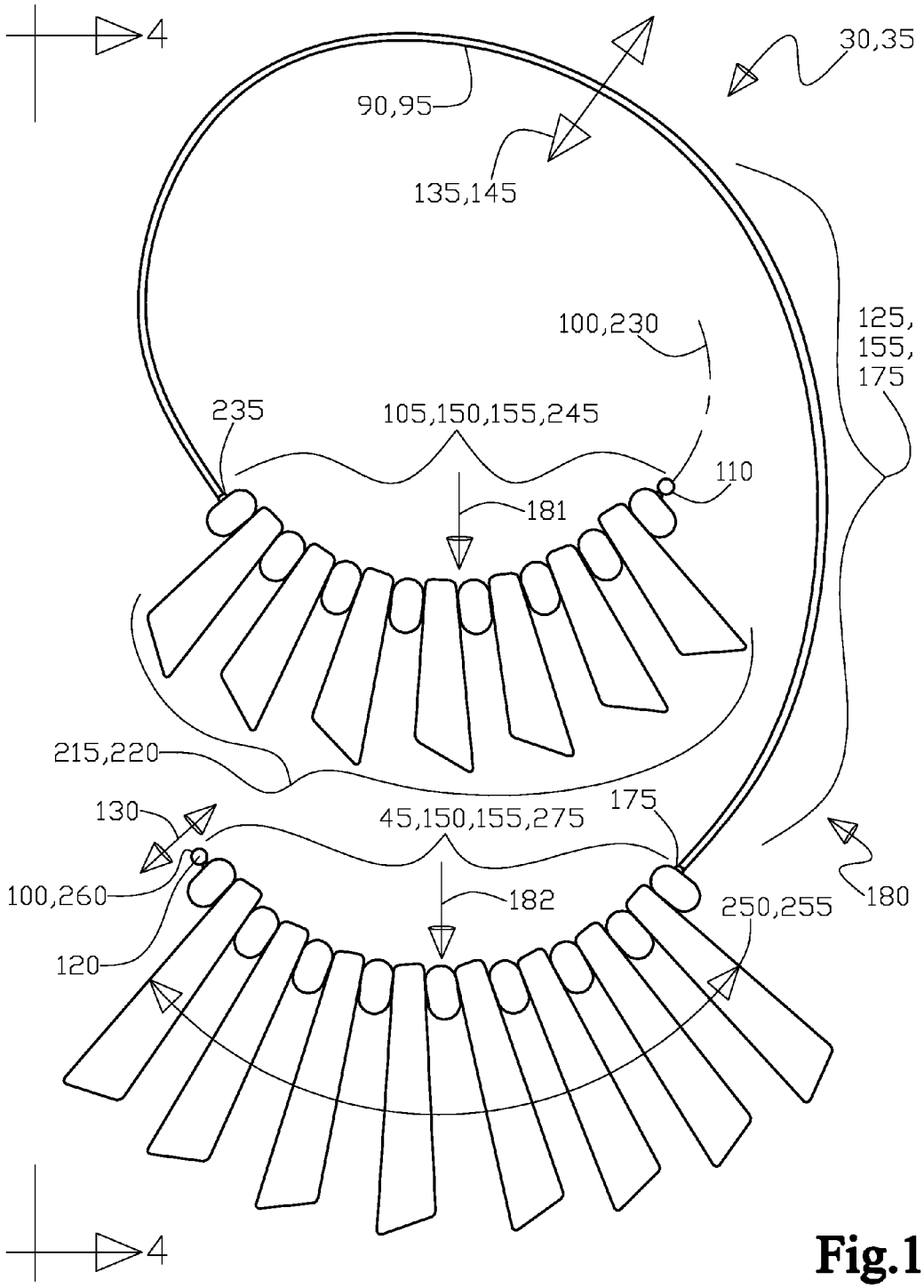
FIG. 1 shows a perspective view of the flexible mass support apparatus positioned substantially flat within a plane, the secondary mass positioned lower than the primary mass, and the flexible element is shown as a wire assuming a spiral shape in a closed state.

The present invention is a flexible mass support apparatus that is designed to be partially positioned about an article such as a neck, wrist, or ankle. The present invention includes a flexible element having a longitudinal axis disposed in between a first end portion and a second end portion wherein the flexible element further assumes a configuration of a portion of a Archimedean spiral shape. Further included in the present invention is a primary mass disposed adjacent to the first end portion and a secondary mass disposed adjacent to the second end portion. Operationally, the flexible element is manually expanded and positioned about the article, and the primary and secondary masses reverse the expanded state to further place the flexible element about the article in a closed state.

REFERENCE NUMBERS IN DRAWINGS

30 Flexible mass support apparatus
35 Jewelry necklace two masses 220 and 255 decorative members respectively
36 Jewelry necklace single mass 225 decorative member
37 Jewelry necklace three masses 220, 255, and 281 decorative members respectively
40 Article
45 Positioned peripherally about the article 40
50 Person
55 Neck of person 50
60 Body of person 50
70 Front of person's body 60
75 Disposing or positioning of the jewelry necklace 35, 36, or 37 about the persons neck 55
80 Plane
85 Vertical plane
90 Flexible element
95 Flexible wire
100 Longitudinal axis of either the flexible element 90 or the flexible wire 95
105 First end portion length of either the flexible element 90 or the flexible wire 95
110 Free end of first end portion 105 of either the flexible element 90 or the flexible wire 95
115 Second end portion length of either the flexible element 90 or the flexible wire 95
120 Free end of second end portion of either the flexible element 90 or the flexible wire 95
125 Intermediate portion length of the flexible wire 95
130 Stiffness of the flexible element 90 or flexible wire 95 intermediate portion 125
135 Movement of the intermediate portion 125 within the vertical plane 85
140 Stiffness of the first end portion 105 of the flexible wire 95
145 Movement of the flexible element 90 or flexible wire 95 in plane 80 or vertical plane 85
150 Combined length of the first end portion 105 and the second end portion 115
155 Total length of the flexible element 90 or flexible wire 95
160 Total length of the flexible wire 95 spiral of four-hundred thirty rotational degrees
165 Flexible wire 95 lying freely in the plane 80
170 Total length of the flexible wire 95 spiral of six-hundred fifty rotational degrees
175 Remaining free flexing length of the flexible element 90 or intermediate portion 125
180 Portion of a substantially Archimedean spiral shape of the flexible element 90 or flexible wire 95
181 Lesser radius of the substantially Archimedean spiral shape of the flexible element 90 or flexible wire 95
182 Greater radius of the substantially Archimedean spiral shape of the flexible element 90 or flexible wire 95
183 Free state of the flexible element 90 or flexible wire 95 wherein the radius is decreasing 195 to a minimum or the winding-up of the flexible element 90 or flexible wire 95
185 Expanded state of the flexible element 90 or flexible wire 95
190 Increased radii of the Archimedean spiral
195 Decreased radii of the Archimedean spiral
200 Reverse of the expanded state
205 Reverse movement of the intermediate portion 125 within the vertical plane 85
210 Closed state
215 Primary mass
220 Primary decorative member
225 Decorative member
230 Primary pivotal axis
235 Pivotal attachment of primary mass 215 or primary decorative member 220 of the decorative member 225 about the primary pivotal axis 230
240 Pivotal movement about the primary pivotal axis 230 of the primary mass 215 or the primary decorative member 220 or the decorative member 225
245 Primary length
250 Secondary mass
255 Secondary decorative member
260 Secondary pivotal axis
265 Pivotal attachment of the secondary mass 250 or secondary decorative member 255 about the secondary pivotal axis 260
270 Pivotal movement about the secondary pivotal axis 260 of the secondary mass 250 or the secondary decorative member 255
275 Secondary length
280 Secondary decorative member 255 positioned at a greater radius 182 of the Archimedean spiral 180
281 Tertiary mass or decorative member
285 Radial alignment within a single angular segment of the primary 220 and secondary 255 decorative members
290 Radial alignment within a single angular segment of the decorative member 225 below the person's neck 55
291 Radial alignment within a single angular segment of the primary 220, secondary 255, and tertiary 281 decorative members
295 Torsional load to avoid that is rotationally perpendicular to the longitudinal axis 100

DETAILED DESCRIPTION

Figure 2:
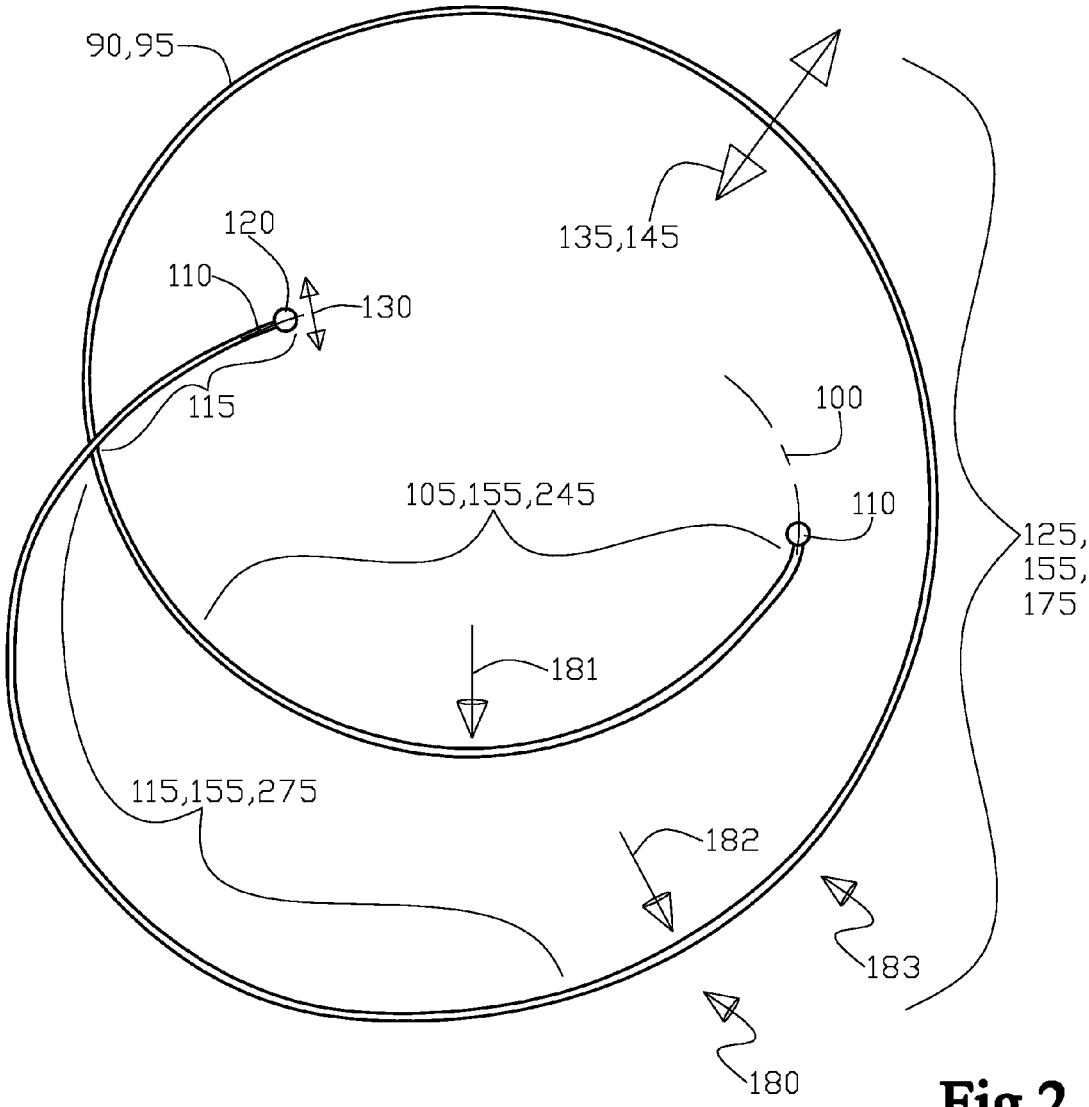
FIG. 2 shows a flat plan view of the flexible element in a free state without the primary or secondary masses in what is defined as the free state.
Figure 3:
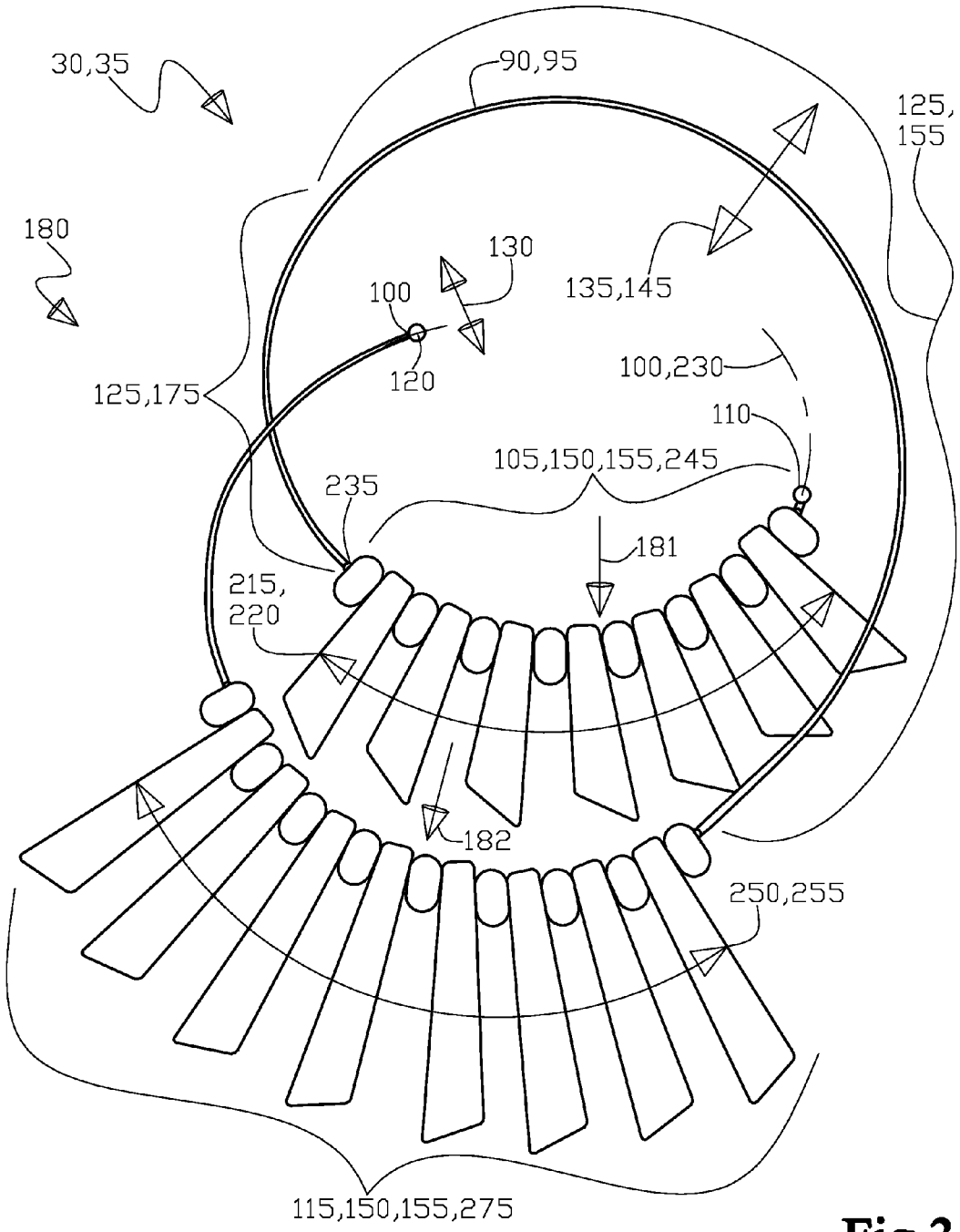
FIG. 3 shows the same flat plan view from FIG. 2 of the flexible element with the addition of the primary mass adjacent to the first end portion, the secondary mass adjacent to the second end portion.

With initial reference to FIG. 1 shown is a perspective view of the flexible mass support apparatus 30 positioned substantially flat within a plane 80, the secondary mass 250 positioned lower than the primary mass 215, and the flexible element 90 is shown as a flexible wire 95 assuming an Archimedean spiral shape 180 in the closed state 210. Next, FIG. 2 shows a flat plan view of the flexible element 90 in a free state 183 lying freely 165 in plane 80 without the primary 215 or secondary 250 masses in what is defined as the free state 183. Continuing, FIG. 3 shows the same flat plan view from FIG. 2 of the flexible element 90 with the addition of the primary mass 215 adjacent to the first end portion 105 and the secondary mass 250 adjacent to the second end portion 115.

Figure 4:
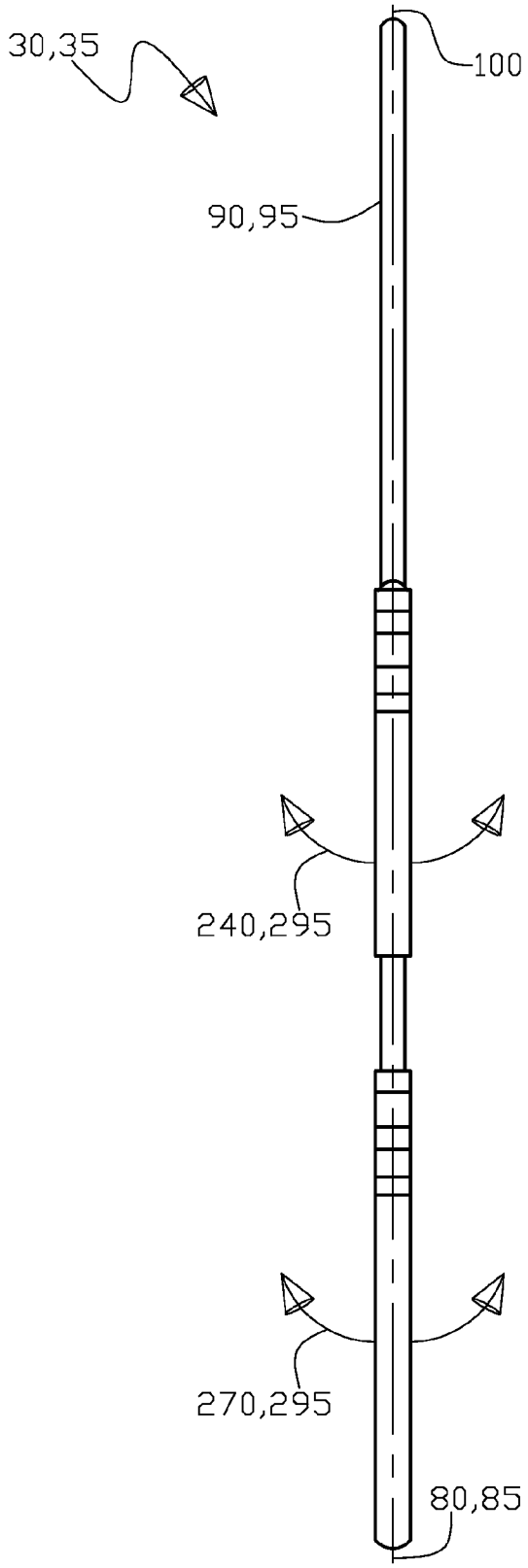
FIG. 4 shows view 4-4 from FIG. 1 of the flexible mass support apparatus suspended substantially flat within the plane, the primary mass and secondary mass are pivotally attached respectively to a primary and a secondary pivotal axis and a pivotal movement is substantially perpendicular to the plane.
Figure 5:
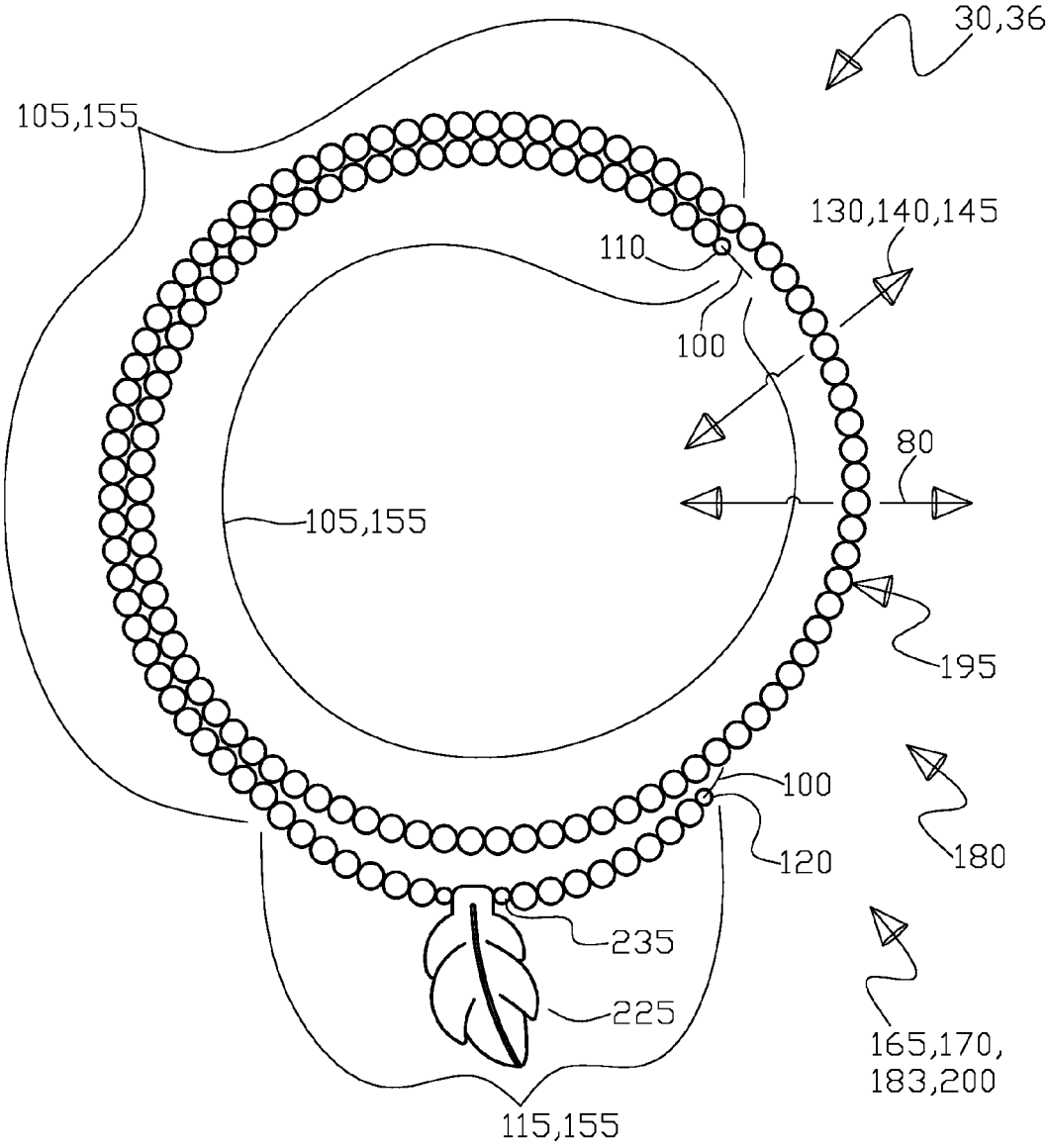
FIG. 5 shows a single decorative member jewelry necklace with the flexible wire lying freely in the plane resulting in a spiral of six-hundred and fifty rotational degrees of the flexible wire defined as being in a free state.
Figure 6:
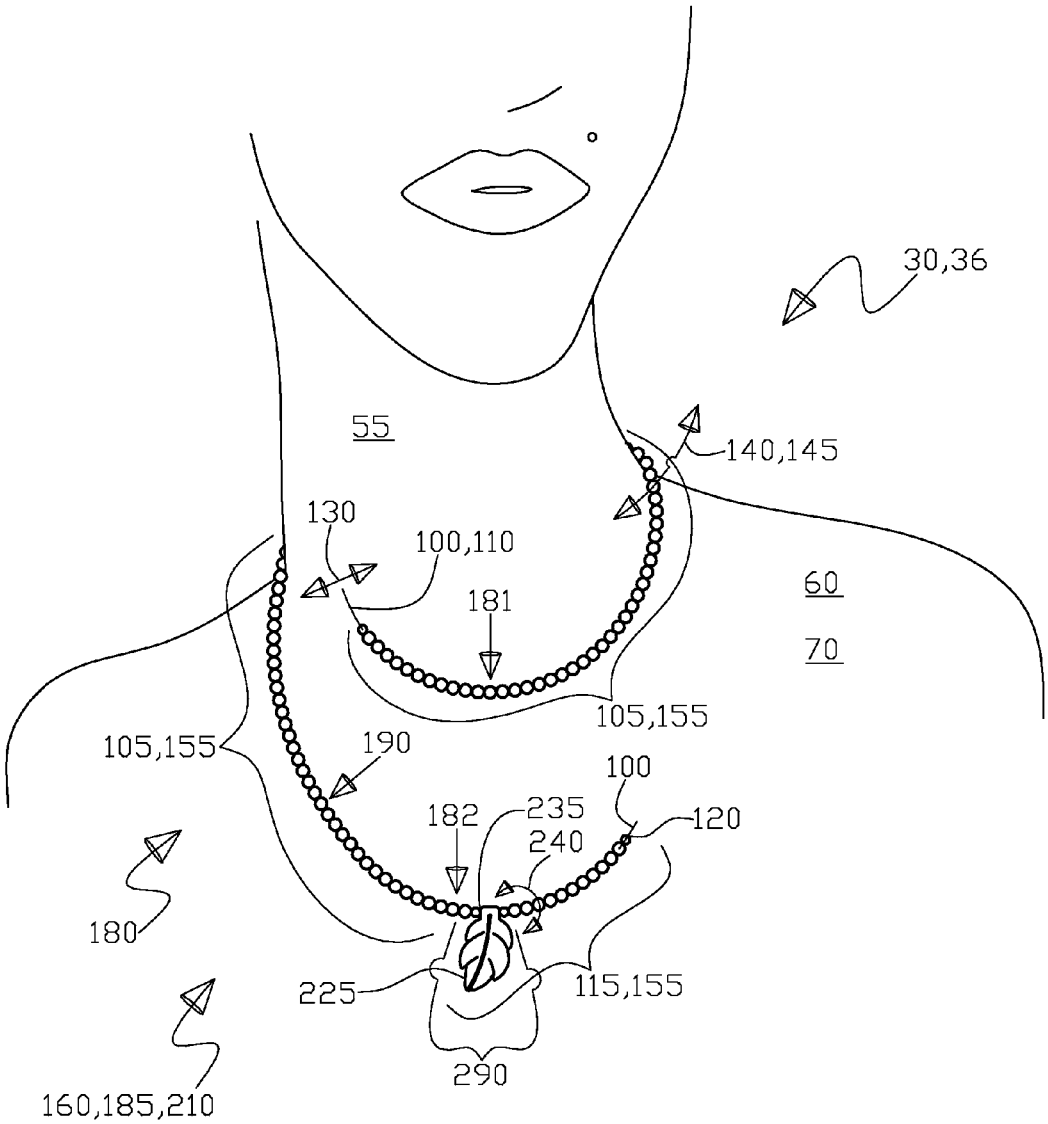
FIG. 6 shows an in use view of the single decorative member jewelry necklace as shown in FIG. 5 with the spiral radius increased to be disposed about the person's neck resulting in a spiral of four-hundred and thirty rotational degrees or what could be termed the closed state of the flexible wire.

Further, FIG. 4 shows view 4-4 from FIG. 1 of the flexible mass support apparatus 30 suspended substantially flat within the plane 80, the primary mass 215 and secondary mass 250 are pivotally attached 235, 265 respectively to a primary 230 and a secondary 260 pivotal axis and a pivotal movement 240, 270 that is substantially perpendicular to the plane 80, respectively for the primary mass 215 and secondary mass 250. Continuing, FIG. 5 shows a single decorative member 225 jewelry necklace 35 with the flexible wire 95 lying freely 165 in the plane 80 resulting in a spiral of six-hundred and fifty rotational degrees 170 of the flexible wire 95 defined as being in a free state 183. Next, FIG. 6 shows an in use view of the single decorative member 225 jewelry necklace 35 as shown in FIG. 5 with the spiral radius increased 190 to be disposed about the person's neck 55, resulting in a spiral of four-hundred and thirty rotational degrees 160 or what could be termed the closed state 210 of the flexible wire 95.

Figure 7:
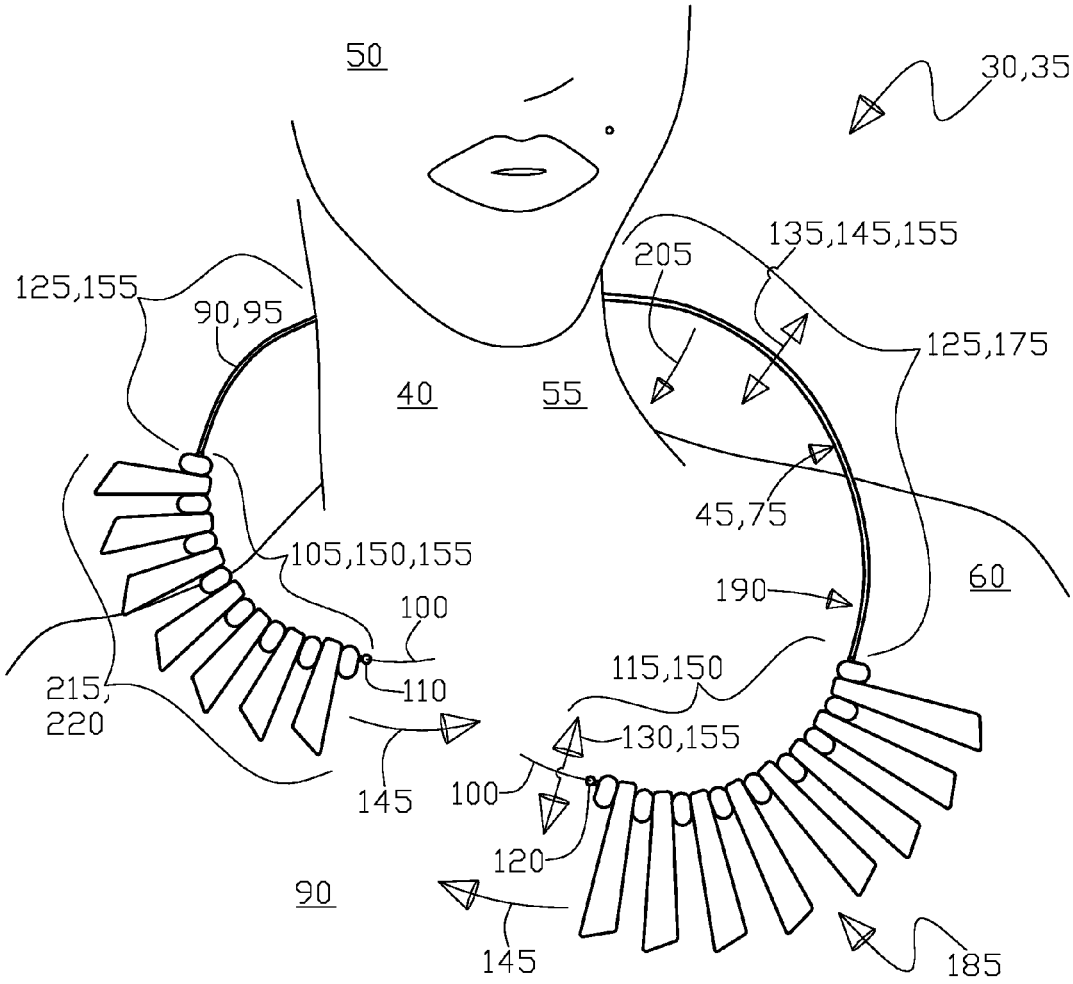
FIG. 7 shows a view of the flexible mass support apparatus or in particular the jewelry necklace being manually placed into an expanded state from the free state via a person using their hands to grasp the flexible element or wire to have movement within the plane to increase the spiral radius to place the flexible element or wire about the person's neck with the jewelry necklace, or in reverse to remove the jewelry necklace from the person's neck by manually expanding the flexible element or wire from the closed state, as shown in FIG. 8 to the expanded state as shown.
Figure 8:
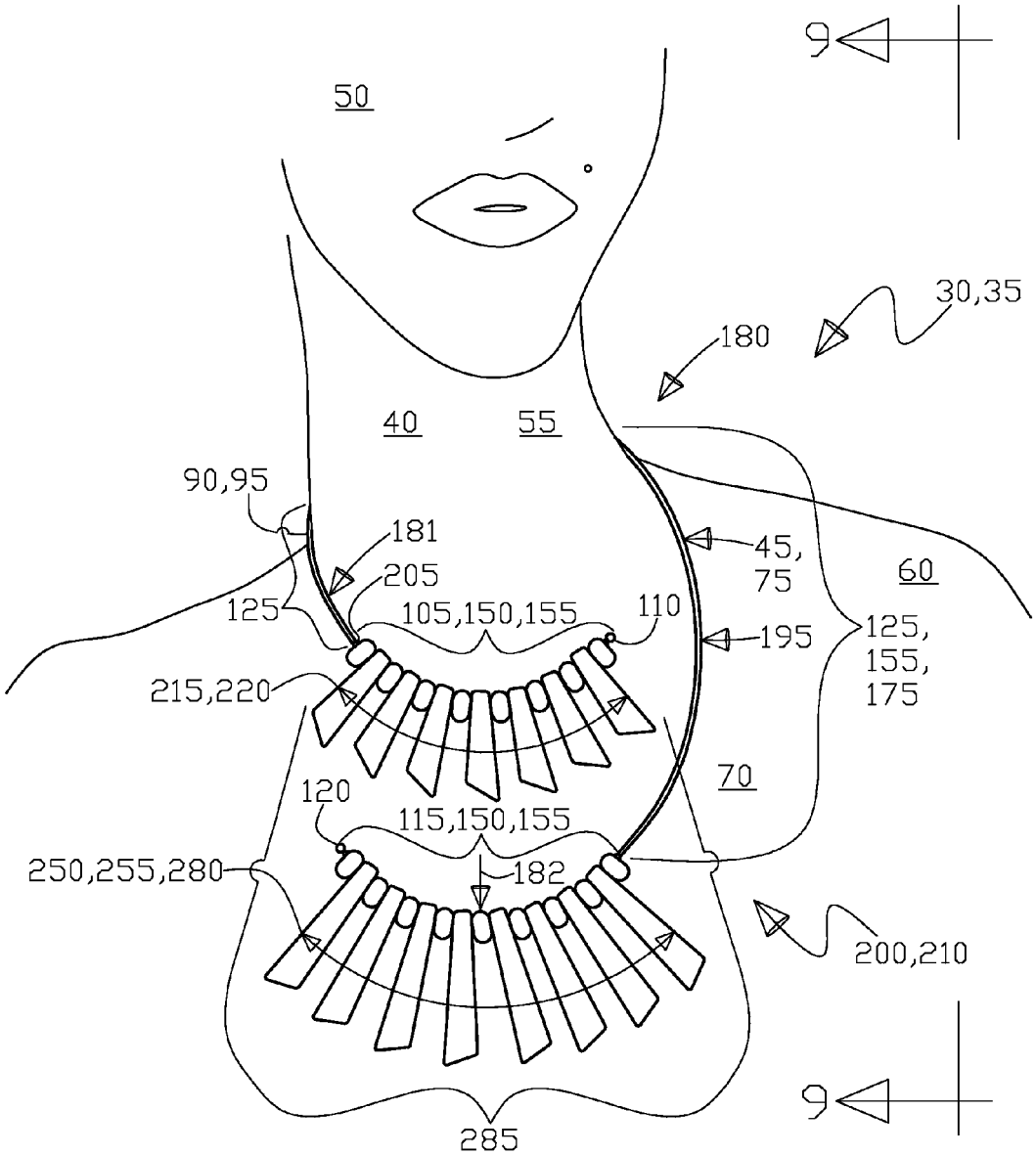
FIG. 8 shows a use front view of the flexible mass support apparatus or jewelry necklace in the closed state circumventing around the person's neck where the secondary mass hangs below the primary mass, appearing evenly spaced and centered in a single angular segment on the front of the person's body with the flexible wire assuming a spiral shape.

Furthermore, FIG. 7 shows a view of the flexible mass support apparatus 30 or in particular the jewelry necklace 35 being manually placed into an expanded state 185 from the free state 183 via a person using their hands to grasp the flexible element 90 or wire 95 to have movement 135, 145 within the plane 80 to increase the spiral radius 190 to place the flexible element 90 or wire 95 about the person's neck 55 with the jewelry necklace 35, or in reverse to remove the jewelry necklace 35 from the person's neck 55 by manually expanding 190 the flexible element 90 or wire 95 from the closed state 210, as shown in FIG. 8 to the expanded state 185 as shown.

Figure 9:
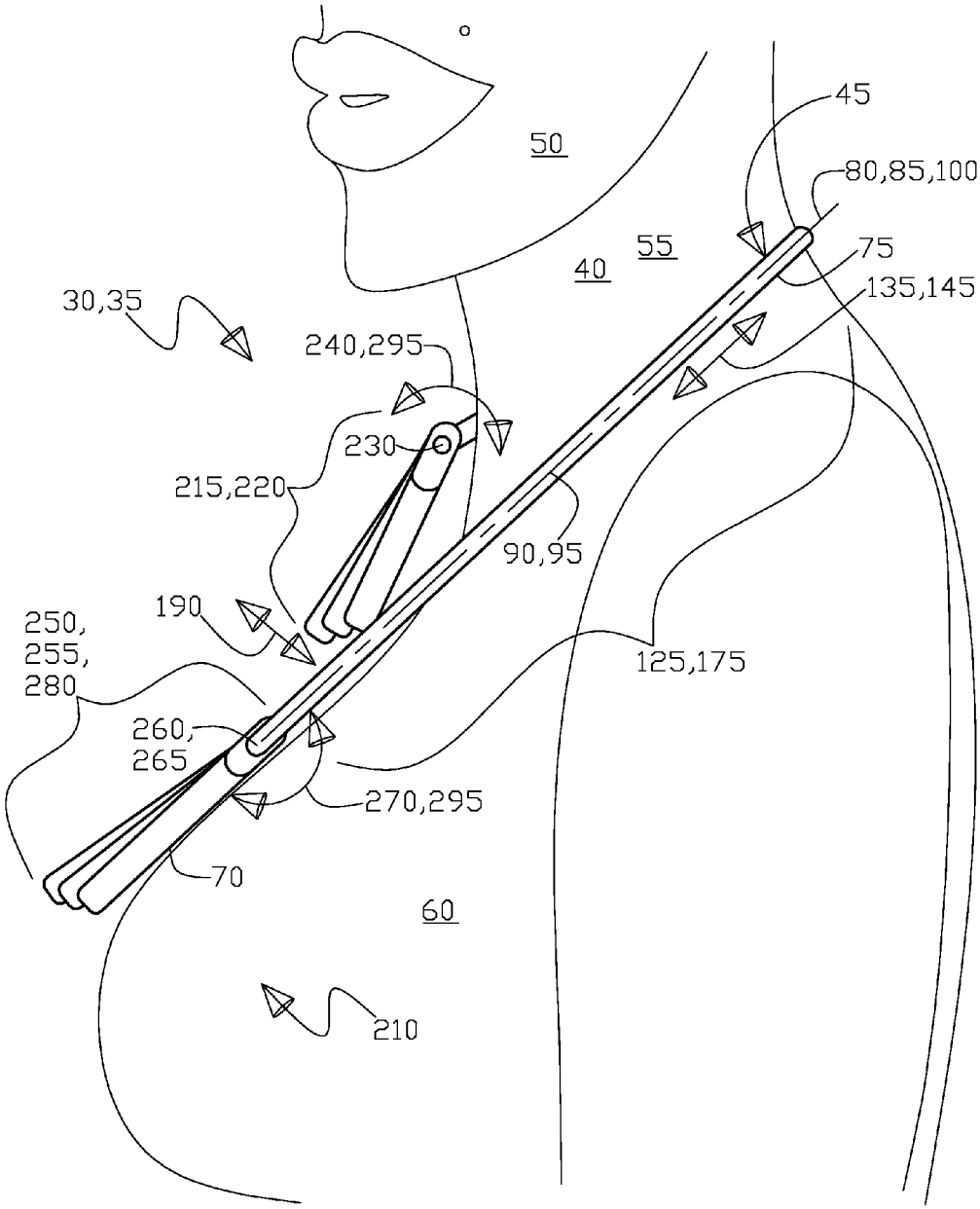
FIG. 9 shows a use side view 9-9 from FIG. 8 of the flexible mass support apparatus or jewelry necklace in the closed state circumventing around the person's neck where the secondary mass hangs below the primary mass, wherein a pivotal movement is shown of the primary and secondary masses in relation to the flexible wire to avoid transmitting rotational torque to the flexible wire from the primary and secondary masses.

Continuing, FIG. 8 shows a use front view of the flexible mass support apparatus 30 or jewelry necklace 35 in the closed state 210 circumventing around the person's neck 55 where the secondary mass 250 hangs below the primary mass 215, appearing evenly spaced and centered in a single angular segment 285 on the front 70 of the person's body 60 with the flexible wire 95 assuming a spiral shape 180. FIG. 9 shows a use side view 9-9 from FIG. 8 of the flexible mass support apparatus 30 or jewelry necklace 35 in the closed state 210 circumventing around the person's neck 55 where the secondary mass 250 hangs below the primary mass 215, wherein a pivotal movement 240, 270 is shown respectively of the primary 215 and secondary 250 masses in relation to the flexible wire 95 to avoid transmitting rotational torque 295 to the flexible wire 95 from the primary 215 and secondary masses 250.

Figure 10:
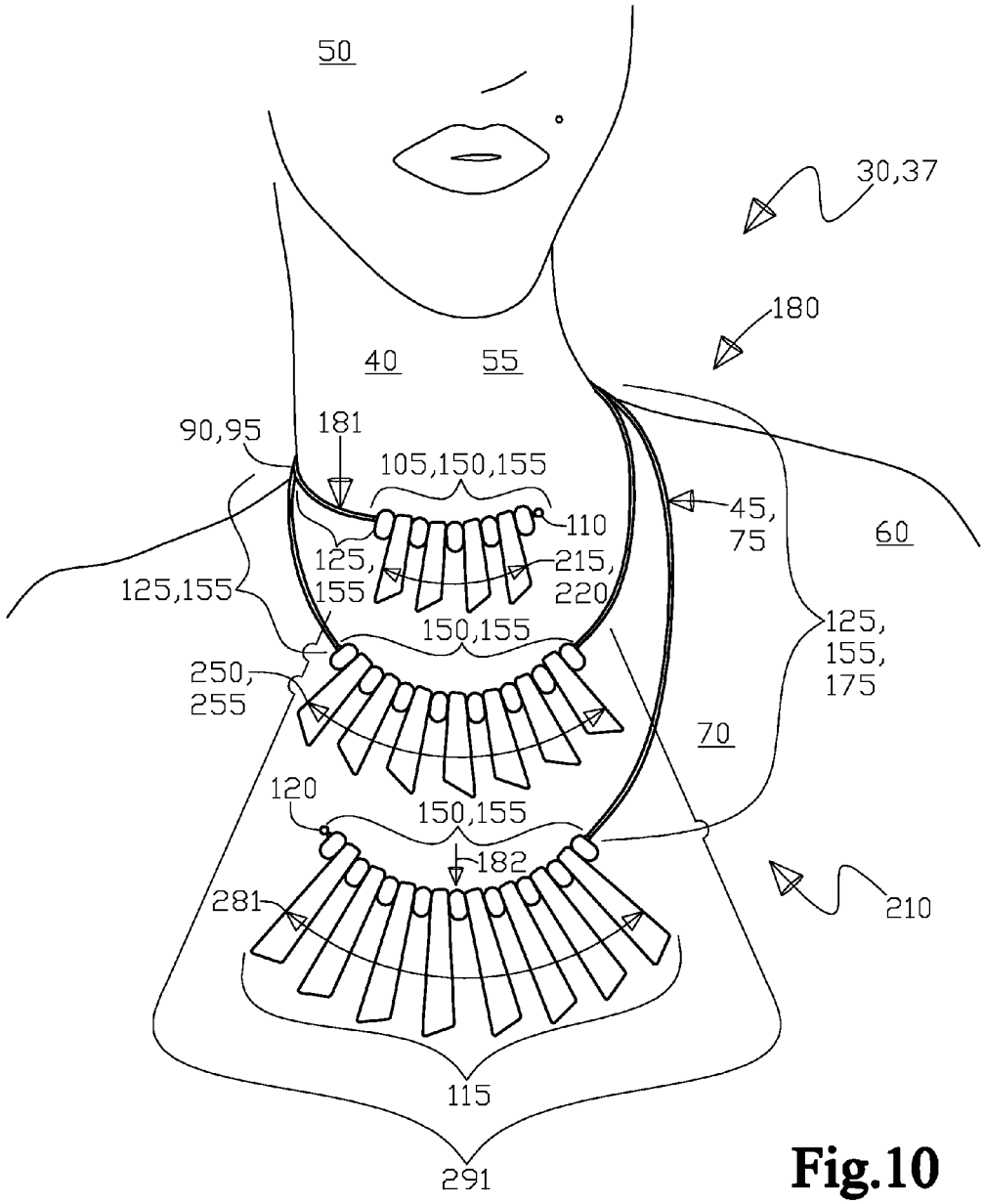
FIG. 10 shows a use front view of the flexible mass support apparatus or jewelry necklace in the closed state circumventing around the person's neck where a tertiary mass hangs below the secondary mass that hangs below the primary mass, appearing evenly spaced and centered in a single angular segment on the front of the person's body with the flexible wire assuming a spiral shape, being much like FIG. 8 with the primary mass and the secondary mass.

Also, FIG. 10 shows a use front view of the flexible mass support apparatus 30 or jewelry necklace 37 in the closed state 210 circumventing around the person's neck 55 where a tertiary 281 mass hangs below the secondary 250 mass that hangs below the primary 215 mass, appearing evenly spaced and centered in a single angular segment 291 on the front 70 of the person's body 60 with the flexible wire 95 assuming a spiral shape 180, being much like FIG. 8 with the primary mass 215 and the secondary mass 250.

With initial reference to FIGS. 1 to 4 and 7 to 9, the flexible mass support apparatus 30 is disclosed that is partially positioned 45 about an article 40, with the flexible mass support apparatus 30 including the flexible element 90 having a longitudinal axis 100, the flexible element 90 also includes a first end portion 105 with a free end 110 and a second end portion 115 with a free end 120 wherein the longitudinal axis 100 is disposed therebetween the first end portion 105 and the second end portion 115. Further, the longitudinal axis 100 assumes a portion of a substantially Archimedean spiral shape 180 of the flexible element 90 or flexible wire 95. This is one of the primary advantages of the present invention in that the free ends 110 and 120 are a distinguishing feature as compared to the prior art necklaces that typically clasp together to stay in place around the person's neck, with the previously discussed issues of poor dexterity or eyesight making the small necklace clasps difficult to attach and separate, furthermore the safety issue of getting the necklace caught in a machine or during a robbery when a mugger may grab the necklace and potentially choke or strangle the person wearing the necklace, wherein the present invention with the free ends 110 and 120 does not have these problems while still staying in place about the person's neck, as the present invention will freely disengage from the person's neck 55 if grabbed by an attacker or caught in a machine and furthermore a person 50 with poor dexterity or eyesight will have no difficulty in putting the present invention on or off their neck.

Further included in the flexible mass support apparatus 30 is the primary mass 215 disposed adjacent to the first end portion 105 and the secondary mass 250 disposed adjacent to said second end portion 115. Note that both the primary mass 215 and the secondary mass 250 can be decorative members 220 and 255 respectively be comprised of multiple pieces as shown of be a single piece as long as there is a somewhat concentrated mass(s) located where specified. Operationally, the flexible element 90 is manually placed in an expanded state 185 to be positioned 45 about the article 40, as shown in FIG. 7, wherein the primary mass 215 and the secondary mass 250 reverse the expanded state 185 into the closed state 210, as shown in FIG. 8 via decreasing the spiral radii 195 from the stiffness of the flexible element 90 to further place the flexible element 90 peripherally 45 about the article 40. To control the stiffness of the flexible element 90 desirably moves 145 substantially within a plane 80 in going from the expanded state 185 to the closed state 210, as best shown in FIGS. 4 through 7 and FIG. 9.

Also to further control stiffness of the flexible element 90 the primary mass 215 is pivotally attached 235 to the first end portion 105 about the primary pivotal axis 230 disposed within the plane 80, and the secondary mass 250 is pivotally attached 265 to the second end portion 115 about a secondary pivotal axis 260 disposed within the plane 80. Wherein operationally, pivotal movement 240 of the primary mass 215 about the primary pivotal axis 230 is substantially perpendicular to the plane 80, and pivotal movement 270 of the secondary mass 250 about the secondary pivotal axis 260 is substantially perpendicular to the plane 80 to avoid a torsional rotational load 295 to be placed on the flexible element 90 that is rotationally perpendicular to the longitudinal axis 100 from the primary mass 215 and the secondary mass 250, as best shown in FIGS. 4 and 9. The purpose of not transmitting torsional rotational load 295 to the flexible element from the primary mass 215 and the secondary mass 250 is to keep movement 145 of the flexible element 90 in plane 80, thus keeping the stiffness constant of the flexible element 90 and to have the flexible mass support apparatus lie substantially flat as against the article 40 or person 60, i.e. such that the flexible element 90 does not twist into a helical configuration which is undesirable for the article 40 or person with the desired positioning of the primary 215 and secondary 250 masses, as shown in FIG. 8 from the flexible element 90 versus the primary 215 and secondary 250 masses.

Further on the flexible element 90 stiffness wherein the flexible element 90 has a stiffness along the longitudinal axis 100 with movement 145 in the plane 80 with a value defined in units of pounds force per inch of movement 145 in the plane, wherein a combined weight of the primary mass 215 being defined in pounds and the secondary mass 250 being defined in pounds is about in the range of one (1.0) to four (4.0) times said stiffness value. The reason for this stiffness to weight relationship is to take the flexible element 90 from the free state 183, as shown in FIG. 2, wherein the flexible element is at its minimum decreased radii 195 of the Archimedean spiral or wound-up with no outside loads on the flexible element 90 in going to the desired closed state 210 as shown in FIG. 8 when the flexible element 90 has load(s) placed upon it, thus resulting in increased radii 190 of the Archimedean spiral, thus the relationship as between the stiffness of the flexible element 90 and the weight of the mass(es) 215, 250, 281, 220, 225, and 255 where applicable.

This relationship was developed from trial and error testing in using 0.025 inches diameter spring steel wire with the primary mass 215 typically weighing about 0.05 pounds and the secondary mass 250 weighing about 0.08 pounds. The actual stiffness of the flexible element 90 is in the range of about 0.03 pounds per inch-qualifies as the weight 215 and 250 and the movement 145 are in the same plane 80 and that there is no torsional rotation forces 295 placed upon the spring steel wire 95. Although the secondary mass 250 weighs more than the primary mass 215-such that the secondary mass 250 hangs below the primary mass 215 there is a limit to the difference in weight between these masses, as extreme unbalance will cause the apparatus 30 or necklace 35 to slide to one side, wherein the limit was determined to be about 0.04 pounds differential or as in the test case above about a two to one limit, in other words the secondary mass 250 weight should not be more than about two times the primary mass 215 weight. Another trial and error consideration was the total weight of the combined primary 215 and secondary 250 masses (or any number of masses for that matter) needed to be limited as the discomfort on the person's neck 55 from the flexible element 90 total weight with the primary 215 and secondary 250 masses combined, would need to be considered, henceforth the above limits.

In the case of the primary 215 and secondary 250 masses being dispersed over a length of the flexible element, again a trial and error limitation would be needed to preserve an open flexing portion or intermediate portion 125 flexing stiffness portion 130 for the case of the necklace 35 to desirably appear as in FIG. 8. Thus the following limits were determined; wherein the primary mass 215 is adjacent to the first end portion 105 along a primary length 245 that is along the longitudinal axis 100 and the secondary mass 250 is adjacent to the second end portion 115 along a secondary length 275 that is along the longitudinal axis 100, and further the flexible element 90 has a total length 155 defined as being from the first end portion 105 to the second end portion 115 combined 150 along the longitudinal axis 100. Wherein the primary length 105 and the secondary length 115 combined 150 have a distance of no more than about forty-five percent (45%) of the total flexible element length 155, wherein about fifty-five (55%) of the flexible element 90 length or as termed the intermediate portion 125 is a remaining free flexing 130 length not being adjacent to the primary mass 215 and the secondary 250 mass, wherein the free flexing length 125 has movement 145 in the plane 80 for stated stiffness 130.

For the more specific embodiment of the flexible mass support apparatus 30 the jewelry necklace 35 is disclosed, of which all the prior analysis applies from the flexible mass support apparatus 30 to the jewelry necklace 35, as shown in FIGS. 1 through 10. The jewelry necklace 35 that is disposed 75 about a person's neck 55, includes a flexible wire 95 having a longitudinal axis 100, the flexible wire 95 also includes a first end portion length 105 with a free end 110, an intermediate portion length 125, and a second end portion length 115 with a free end 120 all combined to define a total flexible wire length 155. Wherein the longitudinal axis 100 is disposed therebetween the first end portion 105 and the second end portion 115, further the longitudinal axis 100 assumes a portion of a substantially Archimedean spiral shape 180 substantially lying within a vertical plane 85, see especially FIGS. 6 through 10.

Also included in the jewelry necklace 35 is the primary decorative member 220 loosely threaded onto the first end portion wire 105, wherein the primary decorative member 220 has a primary weight and freely rotationally pivots 240 about the longitudinal axis 100. Further included in the jewelry necklace 35 is the secondary decorative member 255 loosely threaded onto the second end portion wire 115, wherein the secondary decorative member 255 has a secondary weight and freely rotationally pivots 270 about the longitudinal axis 100. Wherein the secondary weight is not greater than two times the primary weight thus resulting in the secondary decorative member 255 positioned at a greater radius 280 along the substantially Archimedean spiral shape 180 that the primary decorative member 220 with the primary decorative member 220 and the secondary decorative member 255 being radially aligned within a singular angular segment 285 of the substantially Archimedean spiral shape 180, see FIG. 8.

Operationally, the flexible wire 95 is manually placed into an expanded state 185 defined by increasing a radii 190 of the substantially Archimedean spiral shape 180 with a movement 135 of the intermediate portion 125 substantially within the vertical plane 85 to be positioned about 75 the person's neck 55. Wherein the intermediate portion 125 reverses 200 the expanded state 185 movement 205 to a closed state 210 defined by decreasing the radii 181 to place the flexible wire 95 about the person's neck 55, see FIGS. 7 and 8. Wherein the primary decorative member 220 and the secondary decorative member 255 being radially aligned within a singular angular segment 285 of the substantially Archimedean spiral shape 180 in the closed state 210.

Further, on the jewelry necklace 35 the flexible wire 95 intermediate portion 125 has a stiffness 130 along the longitudinal axis 100 in the vertical plane 85 with a value defined in units of pounds force per inch of movement 135 in the vertical plane 85 wherein a combined weight of the primary weight being defined in pounds and the secondary weight being defined in pounds is about in the range of one (1.0) to four (4.0) times the stiffness value 130.

Also, on the jewelry necklace 35 the first end portion 105 and the second end portion 115 have a combined length 150 along the longitudinal axis 100 of no more than about forty-five percent (45%) of the total flexible wire 95 length 155, wherein about fifty-five (55%) of remaining flexible wire length is a free flexing130 length 175 being defined as the intermediate portion 125 along the longitudinal axis 100 not being adjacent to the primary decorative member 220 and the secondary decorative member 255.

Further, in using a single mass for the jewelry necklace 36, the necklace 36 is disposed 75 about a person's neck 55, as best shown in FIGS. 5 and 6, includes the flexible wire 95 having a longitudinal axis 100, the flexible wire 95 also includes a first end portion length 105 with a free end 110 and a second end portion length 115 with a free end 120 both combined to define a total flexible wire length 155. Wherein the longitudinal axis 100 is disposed therebetween the first end portion 105 and the second end portion 115, further the longitudinal axis 100 assumes a portion of a substantially Archimedean spiral shape 180 substantially lying within the vertical plane 85.

Further, included in using a single mass for the jewelry necklace 36 a decorative member 225 loosely threaded onto the second end portion 115 of the wire 95, wherein the decorative member 225 has a weight and freely rotationally pivots 240 about the longitudinal axis 100, the flexible wire 95 first end portion 105 has a stiffness 140 along the longitudinal axis 100 in the vertical plane 85 with a stiffness value 140 defined in units of pounds force per inch of movement in the vertical plane 85 wherein the weight of the decorative member 225 being defined in pounds is about in the range of one-half (0.5) to two (2.0) times the stiffness value, with this ratio reduced due to the single mass being inherently unbalanced as opposed to the two mass system being inherently balanced having the ratio in the range of one (1.0) to four (4.0).

Operationally, the flexible wire 95 is manually placed into an expanded state 185 defined by increasing a radii 182 of said substantially Archimedean spiral shape 180 with a movement 145 of the first end portion 105 substantially within the vertical plane 85 to be positioned about 45 the person's neck 55, wherein the first end portion 105 reverses 200 the expanded state 185 movement 145 to a closed state 210 defined by decreasing the radii 181 to place the flexible wire 95 about 75 the person's neck 55, see FIG. 6. Wherein the decorative member 225 being radially aligned 290 within a singular angular segment of the substantially Archimedean spiral shape 180 in the closed state 210 positioned below the person's neck 55, as shown in FIG. 6.

Looking at particular at FIGS. 5 and 6 for the jewelry necklace 36, the flexible wire 95 as previously defined and as disposed 75 about a person's neck 55 forming a total flexible wire 95 length 155 spiral 180 length of about four-hundred and thirty (430) rotational degrees, as in FIG. 6, and a default state being defined as the flexible wire 95 lying freely 183 in the plane 80 wherein the total flexible wire 95 length 155 form a spiral 180 length of about six-hundred fifty (650) rotational degrees shown to differentiate the flexible wire 95 position with the decorative member 225 weight acting on the wire 95, in FIG. 6 and the flexible wire 95 position without the decorative member 225 weight acting on the wire 95.

Listed below is a typical components list of some sample builds of the jewelry necklace 35, 36, and 37;

For axially securing the free ends 110 and 120 to axially secure the primary mass 215, primary decorative member 220, decorative member 225, secondary mass 250, or secondary decorative member 255 to the flexible wire 95:

1. Solder beads to the wire 95
2. Curl the wire 95 around the last axial bead, band kink the wire 95 at the other end
3. Use a Scrimp bead (screw/crimp beads) from the following list Beadalon 3.5 mm Oval gold bead 407G-014
Beadalon 3.5 mm Oval silver 307B-014
Beadalon 4.5 mm Round Silver 307B-016
Beadalon Cone 307B-022
Beadalon 3.5 mm Oval 307A-014
Beadalon 4.5 mm Round 307A-016
Beadalon Cone 307A-022
Beadalon 3.5 mm Oval 307P-014
Beadalon Memory Wire ends 317B-104 (wire end portion)
Beadalon Memory Wire ends 317A-104 (wire end portion)

4. Crimp bead and cover bead combo Beadalon Crimp beads/tubes 605G-011
607G-025
607G-063
607L-025
JFC0S-25Z
JFC1S-25Z
JFC2S-25Z
JFC3S-25Z
JFC0G-25Z
JFC1G-25z
JFC3G-25Z
JFC1CU-25Z
JFC1B-1.5G
JFC2B-1.5G
JFC1B-25Z
JFC2B-25Z
JFC3B-25Z
Beadalon Crimp covers
3449G-009
449G-011

Wire 95 used for necklaces 35, 36, and 37;

Beadalon Bright JMNT-1ZLG
Beadalon Harvest Gold JMNG-1ZLG
Beadalon Bright JMNG-BULKLG
Beadalon Bright JMNT-1ZXLG
Beadalon Bright JMNT-BULKXLG
Beadalon Bright JMNT-BULK
Beadalon Harvest Gold JMNG-BULK
Beadalon Bright JMBT-BULK
Beadalon Harvest Gold JMBG-Bulk 5. Memory Wire End cap beads applied with glue (doesn't really work)

Memory Wire End Caps Silver 3 mm 60633-2403
Memory Wire End Caps Silver 5 mm 60633-2405
Memory Wire End Caps Gold, 3 mm 60633-4023
Memory Wire End Caps, Gold, 5 mm 60633-4025

Necklace 35 weights

1. Style-Lapis

Top 215=16 g
Bottom 250=26 g
Total=42 g
Ratio=0.615
Wire 95 Length 155=21.5"

2. Style-Southwestern

Top 215=19 g
Bottom 250=27 g
Total=46 g
Ratio=0.703
Wire 95 length 155=21.5"

3. Style-Nefertiti

Top 215=20 g
Bottom 250=30 g
Total=50 g
Ratio=0.66
Wire 95 length 155=21.5"

4. Style-Kleo

Top 215=21 g
Bottom 250=30 g
Total=51 g
Ratio=7.
Wire 95 length 155=21.5"

5. Style-Amethyst

Top 215=20
Bottom 250=33
Total=53
Ratio 0.60
Wire 95 length 155=23"

6. Style-Kyanite crystals

Top 215=23 g

Bottom 250=36 g
Total=59 g
Ratio=0.63
Wire 95 length 155=22.5"
7. Style-Love and Power
Top=215=20.5 g
Bottom=250=30.8 g
Total=51.4 g
Ratio=0.66
Wire 95 length 155=22.5"
Averages
Top 215=20.5 g
Bottom 250=30.8 g
Total=51.4 g
Ratio=0.66
Wire 95 length 155=22"

METHOD OF USE

Looking particularly at FIGS. 6 through 10, a method of adorning a person's neck 55 with a necklace 35 is shown, comprising the steps of first providing a necklace 35 as previously described and shown in FIG. 3 or 10. A second step comprises manually grasping the necklace 35 along the longitudinal axis 100 at the first end portion 105 and at the second end portion 115 when the necklace 35 is in the free state 183 as shown in FIG. 3. A next third step comprises manually moving 145 the first end portion 105 and the second end portion 115 in opposite directions apart in the plane 80 to take the necklace 35 into the expanded state 185, as best shown in FIG. 7. Operationally, the flexible wire 95 is moved 145 into a larger increasing radius 190 spiral expanded state 185 to dispose the necklace 35 and in particular the flexible wire 95 about the person's neck 55. A further fourth step comprises placing the necklace 35 about the person's neck 55 wherein the primary mass 215 and secondary mass 250 are adjacent to the front 70 of the person's body 60, as best shown in FIG. 7. A fifth step comprises positioning the primary mass 215 and the secondary mass 250 apart from each other such that said secondary mass 250 hangs lower than the primary mass 215 to achieve both the primary 215 and secondary 250 masses to be in a singular angular segment 285 to appear symmetrical to one another, as best shown in FIG. 8, note that for the addition of the tertiary mass 281, as shown in FIG. 10 the same process would apply, wherein three masses being the primary 215, secondary 250, and the tertiary 281 masses would be positioned and aligned in a like manner. This aforementioned positioning of the primary 215, secondary 250, and optional tertiary 281 masses further allows the necklace 35 to stay in place without unnecessarily sliding around the person's neck 55, a common problem with the prior art.

In looking at FIGS. 5 and 6, a similar procedure would apply for the use of a single decorative member 225 jewelry necklace 35. Comprising a first step of providing a necklace 35 as previously described and shown in FIG. 5. A second step comprises manually grasping the necklace 35 along the longitudinal axis 100 at the first end portion 105 and at the second end portion 115 when the necklace 35 is in the free state 183 as shown in FIG. 5. A next third step comprises manually moving 145 the first end portion 105 and the second end portion 115 in opposite directions apart in the plane 80 to take the necklace 35 into having an increased radii 190 of the spiral, as best shown in FIG. 6. Operationally, the flexible wire 95 is moved 145 into a larger increasing radius 190 spiral to dispose the necklace 35 and in particular the flexible wire 95 about the person's neck 55. A further fourth step comprises placing the necklace 35 about the person's neck 55 wherein the decorative member 225 is adjacent to the front 70 of the person's body 60, as best shown in FIG. 6. A fifth step comprises positioning the decorative member 225 such that it has radial alignment 290 to appear symmetrical, as best shown in FIG. 6. This aforementioned positioning of the decorative member 225 further allows the necklace 35 to stay in place without unnecessarily sliding around the person's neck 55, a common problem with the prior art.

CONCLUSION

Accordingly, the present invention of a flexible mass support apparatus 30 has been described with some degree of particularity directed to the embodiments of the present invention. It should be appreciated, though, that the present invention is defined by the following claims construed in light of the prior art so that modifications or changes may be made to the exemplary embodiments of the present invention without departing from the inventive concepts contained therein.

The invention claimed is:

1. A flexible mass support apparatus, said apparatus is partially positioned about an article, comprising:

(a) a primary mass;

(b) a secondary mass; and (c) a flexible element having a longitudinal axis, said flexible element also includes a first end portion with a free end and a second end portion with a free end wherein said longitudinal axis is disposed therebetween said first end portion and said second end portion, further said longitudinal axis assumes a portion of a substantially Archimedean spiral shape, wherein said flexible element moves substantially within a plane in going from an expanded state to a closed state, wherein said primary mass is disposed adjacent to said first end portion and said secondary mass is disposed adjacent to said second end portion, wherein said flexible element has a stiffness along said longitudinal axis with movement in said plane with a value defined in units of pounds force per inch of movement in said plane, wherein a combined weight of said primary mass being defined in pounds and said secondary mass being defined in pounds is about in the range of one (1.0) to four (4.0) times said stiffness value operationally said flexible element is manually placed in said expanded state to be positioned about the article, wherein said primary mass and said secondary mass reverse said expanded state into said closed state to further place said flexible element peripherally about the article.

2. A flexible mass support apparatus according to claim 1 wherein said primary mass is pivotally attached to said first end portion about a primary pivotal axis disposed within said plane, and said secondary mass is pivotally attached to said second end portion about a secondary pivotal axis disposed within said plane, wherein operationally, pivotal movement of said primary mass about said primary pivotal axis is substantially perpendicular to said plane, and pivotal movement of said secondary mass about said secondary pivotal axis is substantially perpendicular to said plane to avoid a torsional load to be placed on said flexible element that is rotationally perpendicular to said longitudinal axis from said primary mass and said secondary mass.

3. A flexible mass support apparatus according to claim 1 wherein said primary mass is adjacent to said first end portion along a primary length that is along said longitudinal axis and said secondary mass is adjacent to said second end portion along a secondary length that is along said longitudinal axis, and further said flexible element has a total length defined as being from said first end portion to said second end portion along said longitudinal axis wherein said primary length and said secondary length combined have a distance of no more than about forty-five percent (45%) of said total flexible element length, wherein about fifty-five (55%) of said flexible element length is a remaining free flexing length not being adjacent to said primary mass and said secondary mass, wherein said free flexing length has movement in said plane.

4. A jewelry necklace, said necklace is disposed about a person's neck, comprising:

(a) a flexible wire having a longitudinal axis, said flexible wire also includes a first end portion length with a free end, an intermediate portion length, and a second end portion length with a free end all combined to define a total flexible wire length, wherein said longitudinal axis is disposed therebetween said first end portion and said second end portion, further said longitudinal axis assumes a portion of a substantially Archimedean spiral shape substantially lying within a vertical plane;

(b) a primary decorative member loosely threaded onto said first end portion wire, wherein said primary decorative member has a primary weight and freely rotationally pivots about said longitudinal axis; and (c) a secondary decorative member loosely threaded onto said second end portion wire, wherein said secondary decorative member has a secondary weight and freely rotationally pivots about said longitudinal axis, wherein said secondary weight is no greater than two times said primary weight thus resulting in said secondary decorative member positioned at a greater radius along said substantially Archimedean spiral shape than said primary decorative member with said primary decorative member and said secondary decorative member being radially aligned within a singular angular segment of said substantially Archimedean spiral shape, operationally, said flexible wire is manually placed into an expanded state defined by increasing a radii of said substantially Archimedean spiral shape with a movement of said intermediate portion substantially within said vertical plane to be positioned about the person's neck, wherein said intermediate portion reverses said expanded state movement to a closed state defined by decreasing said radii to place said flexible wire about the person's neck, wherein said primary decorative member and said secondary decorative member being radially aligned within a singular angular segment of said substantially Archimedean spiral shape in said closed state.

5. A jewelry necklace according to claim 4 wherein said flexible wire intermediate portion has a stiffness along said longitudinal axis in said vertical plane with a value defined in units of pounds force per inch of movement in said vertical plane wherein a combined weight of said primary weight being defined in pounds and said secondary weight being defined in pounds is about in the range of one (1.0) to four (4.0) times said stiffness value.

6. A jewelry necklace according to claim 5 wherein said first end portion and said second end portion have a combined length along said longitudinal axis of no more than about forty-five percent (45%) of said total flexible wire length, wherein about fifty-five (55%) of remaining said flexible wire length is a free flexing length being defined as said intermediate portion along said longitudinal axis not being adjacent to said primary decorative member and said secondary decorative member.

* * * * *